US009429330B2

(12) United States Patent
King

(10) Patent No.: US 9,429,330 B2
(45) Date of Patent: Aug. 30, 2016

(54) CLOSED LOOP HEATING SYSTEM

(75) Inventor: Ray King, Pickering (CA)

(73) Assignee: DYNACURRENT TECHNOLOGIES, INC. (CA)

( * ) Notice: Subject to any disclaimer, the term of this patent is extended or adjusted under 35 U.S.C. 154(b) by 1172 days.

(21) Appl. No.: 12/557,682

(22) Filed: Sep. 11, 2009

(65) Prior Publication Data

US 2010/0059599 A1 Mar. 11, 2010

Related U.S. Application Data

(63) Continuation-in-part of application No. 12/457,397, filed on Jun. 10, 2009.

(51) Int. Cl.
*F24D 3/02* (2006.01)
*H05B 3/78* (2006.01)
(Continued)

(52) U.S. Cl.
CPC ..... *F24D 13/04* (2013.01); *F24H 3/004* (2013.01); *F24H 9/1818* (2013.01); *F24H 9/1863* (2013.01); *F24D 2220/2072* (2013.01)

(58) Field of Classification Search
CPC .... F24H 3/004; F24H 9/1818; F24H 9/1863; F24H 1/102; F24D 3/02; F24D 13/04
USPC ..... 237/63; 392/485
See application file for complete search history.

(56) References Cited

U.S. PATENT DOCUMENTS 1,376,509 A 5/1921 Borst, Jr.
1,485,666 A 3/1924 Coldwell
(Continued)

FOREIGN PATENT DOCUMENTS

CA 2017503 11/1990
CA 2551341 12/2007
(Continued)

OTHER PUBLICATIONS

"Glow Plugs as Cooling Water Pre-Heater in Modern Diesel Cars (Type GN)"; BERU AG, Nov. 5, 2002. Archive.org Apr. 22, 2008. <http://web.archive.org/web/20021115200353/http://www.beru.com/english/produkte/gluehkerzen/gn.php>.
(Continued)

*Primary Examiner* — Alissa Tompkins
*Assistant Examiner* — Phillip E Decker
(74) *Attorney, Agent, or Firm* — Schmeisser, Olsen & Watts, LLP

(57) ABSTRACT

A heating system comprising a first flow pipe and a second flow pipe which are interconnected at ends thereof to form a closed loop fluid flow circuit. A housing having a passage extending therethrough for passage of water through the housing is interconnected with the fluid flow circuit, and a pump is utilized to circulate water through the fluid flow circuit. The housing provides at least one opening defined therein separate from the passage, and at least one heating element is inserted therein, projecting into the housing, so as to be in direct contact with the water therein. The heating element is powered by a power source for enabling the heating element to heat the water and operate the pump. Radiator panels are connected to the fluid flow circuit, to radiate the heat from the heated water flowing in the fluid flow circuit to a space heated by the heating system. A thermostatic safety control is provided in association with the heating element, which is adapted to turn the heating element off when a temperature of the water exceeds a pre-determined level. In another embodiment, a remote device can be used to selectively activate, or deactivate, the power source in heating the heating element.

18 Claims, 5 Drawing Sheets

(51) Int. Cl.

| | |
|---|---|
| ***F24D 13/04*** | (2006.01) |
| ***F24H 3/00*** | (2006.01) |
| ***F24H 9/18*** | (2006.01) |

(56) References Cited

U.S. PATENT DOCUMENTS

| | | | | |
|---|---|---|---|---|
| 1,485,667 | A | 3/1924 | Coldwell | |
| 1,505,179 | A | 8/1924 | Whitely | |
| 1,509,207 | A | 9/1924 | Hudson | |
| 1,519,395 | A | 12/1924 | Clench | |
| 1,546,959 | A | 7/1925 | Wilson | |
| 1,759,389 | A | 5/1930 | Bowen | |
| 1,816,850 | A | 8/1931 | Hurd | |
| 1,850,156 | A | 3/1932 | Richardson | |
| 1,985,830 | A | 12/1934 | Hynes | |
| 2,205,145 | A * | 6/1940 | Klingner | 123/145 A |
| 2,266,216 | A | 12/1941 | Kimberlin | |
| 2,557,369 | A * | 6/1951 | Broderick | 237/63 |
| 2,589,566 | A | 3/1952 | Neth et al. | |
| 2,607,535 | A * | 8/1952 | Moore | F24D 19/1066 237/19 |
| 2,686,863 | A | 8/1954 | Chandler | |
| 2,745,941 | A * | 5/1956 | McElhaney | 237/8 R |
| 2,775,682 | A | 12/1956 | Hynes | |
| 2,791,271 | A * | 5/1957 | Kauffeld | 237/2 R |
| 2,813,964 | A | 11/1957 | Cerulli | |
| 2,825,791 | A | 3/1958 | Jackson | |
| 2,834,865 | A | 5/1958 | Coates | |
| 3,171,016 | A | 2/1965 | Sukala | |
| 3,209,123 | A | 9/1965 | Windsor | |
| 3,280,299 | A | 10/1966 | Doniak | |
| 3,353,000 | A | 11/1967 | Tomlinson | |
| 3,435,404 | A * | 3/1969 | Kato | 439/125 |
| 3,484,580 | A | 12/1969 | Morgan | |
| 3,496,991 | A | 2/1970 | Barnd | |
| 3,520,137 | A * | 7/1970 | Newman et al. | 60/221 |
| 3,626,148 | A * | 12/1971 | Woytowich | F24H 1/225 392/489 |
| 3,638,619 | A | 2/1972 | Hall et al. | |
| 3,646,314 | A | 2/1972 | Windsor | |
| 3,673,385 | A | 6/1972 | Drugmand et al. | |
| 3,756,903 | A * | 9/1973 | Jones | G05D 23/1919 165/104.21 |
| 3,868,494 | A | 2/1975 | Pepin | |
| 3,919,520 | A | 11/1975 | Pickard | |
| 3,969,605 | A | 7/1976 | Danell | |
| 4,208,570 | A | 6/1980 | Rynard | |
| 4,245,593 | A | 1/1981 | Stein | |
| 4,286,139 | A | 8/1981 | Taylor | |
| 4,377,737 | A | 3/1983 | Berry | |
| 4,395,618 | A | 7/1983 | Cunningham | |
| 4,419,567 | A * | 12/1983 | Murphy et al. | 392/451 |
| 4,489,242 | A | 12/1984 | Worst | |
| 4,514,617 | A | 4/1985 | Amit | |
| 4,604,515 | A | 8/1986 | Davidson | |
| 4,617,456 | A | 10/1986 | Richards et al. | |
| 4,692,592 | A | 9/1987 | Kale | |
| 4,732,229 | A | 3/1988 | Lucht | |
| 4,770,134 | A | 9/1988 | Foreman et al. | |
| 4,808,793 | A | 2/1989 | Hurko | |
| 4,835,365 | A | 5/1989 | Etheridge | |
| 4,891,335 | A | 1/1990 | McNeilly | |
| 5,216,743 | A | 6/1993 | Seitz | |
| 5,285,963 | A | 2/1994 | Wakefield et al. | |
| 5,400,432 | A | 3/1995 | Kager et al. | |
| 5,408,960 | A | 4/1995 | Woytowich | |
| 5,438,642 | A | 8/1995 | Posen | |
| 5,940,270 | A * | 8/1999 | Puckett | F28D 15/0266 165/104.33 |
| 6,157,776 | A * | 12/2000 | Onken | 392/441 |
| 6,215,310 | B1 * | 4/2001 | Petrovich et al. | 324/378 |
| 6,243,535 | B1 | 6/2001 | Bochud | |
| 6,289,177 | B1 | 9/2001 | Finger et al. | |
| 6,424,801 | B1 | 7/2002 | Rabadi | |
| 6,643,454 | B1 * | 11/2003 | Rochelle | 392/485 |
| 6,647,204 | B1 | 11/2003 | Hutchinson | |
| 6,873,793 | B2 * | 3/2005 | Thweatt, Jr. | 392/488 |
| 6,996,336 | B1 | 2/2006 | Mahoney et al. | |
| 7,039,305 | B1 | 5/2006 | Chen | |
| 7,065,292 | B2 * | 6/2006 | Thweatt, Jr. | 392/488 |
| 7,082,904 | B2 | 8/2006 | Takano | |
| 7,207,379 | B2 | 4/2007 | Takano et al. | |
| 7,330,645 | B2 | 2/2008 | Kwon | |
| 7,572,480 | B2 * | 8/2009 | May et al. | 427/97.1 |
| 8,515,268 | B2 | 8/2013 | Anliker | |
| 8,855,475 | B2 * | 10/2014 | King | 392/441 |
| 8,933,372 | B2 * | 1/2015 | King | 237/12.3 R |
| 2002/0146244 | A1 * | 10/2002 | Thweatt, Jr. | 392/488 |
| 2003/0039474 | A1 | 2/2003 | Eller et al. | |
| 2004/0022529 | A1 * | 2/2004 | Lamb | 392/465 |
| 2004/0170411 | A1 | 9/2004 | Kuebler et al. | |
| 2006/0163235 | A1 | 7/2006 | Warren et al. | |
| 2008/0083737 | A1 * | 4/2008 | Vu | 219/497 |
| 2008/0156285 | A1 * | 7/2008 | King | 123/142.5 E |
| 2009/0107974 | A1 * | 4/2009 | Testa | B60H 1/034 392/485 |
| 2009/0139472 | A1 | 6/2009 | Gehres et al. | |
| 2012/0223065 | A1 | 9/2012 | King | |
| 2012/0224836 | A1 | 9/2012 | King | |
| 2013/0016959 | A1 * | 1/2013 | King | 237/63 |
| 2013/0206744 | A1 * | 8/2013 | King | 219/208 |

FOREIGN PATENT DOCUMENTS

| | | | |
|---|---|---|---|
| CA | 2668817 | A1 * | 12/2010 |
| EP | 0488926 | A1 * | 6/1992 |
| JP | 57-173558 | | 10/1982 |
| KP | 10-2004-0001394 | A | 1/2004 |
| KR | 10-2004-0001395 | A | 1/2004 |
| KR | 10-2004-0061534 | A | 7/2004 |
| WO | WO-2008/000076 | A1 | 1/2008 |

OTHER PUBLICATIONS

"Internet Archive Wayback Machine." Archive.org Apr. 11, 2008. <http://web.archive.org/web/*/http://www.beru.com/english/produkte/gluehkerzen/gn.php>.

U.S. Appl. No. 12/457,397, filed Jun. 10, 2009, King, Ray.

U.S. Appl. No. 13/666,537, filed Nov. 1, 2012, King, Ray.

Written Opinion of the International Searching Authority ; PCT/CA2007/001145; 5 pages; Oct. 5, 2007.

International Preliminary Report on Patentability; PCT/CA2007/001145; 3 pages; Oct. 30, 2008.

Office Action in U.S. Appl. No. 13/064,075; issued Jul. 23, 2013; 8 pages.

Office Action in U.S. Appl. No. 12/457,397, issued Jul. 30, 2013; 22 pages.

Office Action U.S. Appl. No. 13/507,604; Dec. 4, 2013; 14 pages.

Non-Final Office Action dated Feb. 28, 2014 for U.S. Appl. No. 13/137,041, filed Jul. 18, 2011.

* cited by examiner

CLOSED LOOP HEATING SYSTEM

This application is a continuation-in-part of U.S. application Ser. No. 12/457,397, filed on Jun. 10, 2009.

This invention relates generally to a heating system, and more particularly to an improved closed loop heating system which is durable and reliable, that possesses easily removable or replaceable heating elements, and which can be easily installed in a home.

DESCRIPTION OF THE PRIOR ART

It is well known that furnaces are used to heat homes. Traditionally, such furnaces were oil furnaces. However, as the demand for oil has risen sharply in the last decade, the price has correspondingly risen sharply, reducing the ability of such furnaces to be economical to the home or business owner. Recently, gas-fired furnaces, using natural gas, have been much in demand for homeowners in economically heating their home. However, much as has occurred with oil, natural gas has also seen large price increases in the last couple of years, which has also reduced the economical viability of gas-fired furnaces.

It is also well known to heat homes using, for example, electrical baseboards, but, as hydro rates have risen quite sharply recently, and can be expected to continue upwardly in the future, these types of devices are not necessarily economical also. What is required is a heating system which is very economical, and which can generate substantial amounts of heat to heat larger spaces, such as in a home or business. Thus, there is a further need for an improved environmentally friendly heating system for heating a space which has a generally uncomplicated and simple design, which may be installed easily, and is durable and reliable, and which possesses easily removable or replaceable heating elements.

There is also a need for an improved closed loop heating system which utilizes environmentally friendly heating elements which have a generally uncomplicated and simple design, which may be installed or removed easily, and which, by virtue of its design, are more durable and reliable to withstand the constant flow of coolant or fluid flowing around it over time. There is also a further need for an improved closed loop heating system using heating elements having a greater surface area so as to contact the coolant or fluid flowing past and around it, therefore heating the coolant or fluid in a faster and more efficient manner. In this regard, the present invention substantially fulfills this need.

SUMMARY OF THE INVENTION

It is an object and advantage of the present invention to provide an improved heating system which is environmentally friendly and extremely economical, and which has a generally uncomplicated and simple design, and which may be installed easily.

It is another object and advantage of the present invention to provide an improved heating system which is durable and reliable, and which possesses easily removable or replaceable heating elements.

It is another object and advantage of the present invention to provide an improved heating system which can be run with a minimum of electrical power, and yet which can generate substantial amounts of heat to heat larger spaces.

It is another object and advantage of the present invention to provide an improved heating system which utilizes environmentally friendly heating elements which have a generally uncomplicated and simple design, which may be installed or removed easily, and which, by virtue of its design, are more durable and reliable.

It is another object of the present invention to provide an improved heating system which utilizes heating elements having a greater surface area so as to contact the coolant or fluid flowing past and around it, and therefore heating the coolant or fluid in a faster and more efficient manner.

According to one aspect of the present invention, there is provided a closed loop heating system for heating a space comprising a first flow pipe and a second flow pipe, the first flow pipe and the second flow pipe being interconnected at ends thereof to form a closed loop fluid flow circuit; a housing interconnected with the closed loop fluid flow circuit, and having a passage extending therethrough for passage of a heatable transfer fluid through the housing, the housing having at least one opening defined within the housing which is separate from the passage; at least one electric heating element inserted into the at least one opening, the at least one electric heating element being removable from the housing without disassembly of the housing and without disconnection of the housing from the closed loop fluid flow circuit, and wherein the at least one electric heating element has a substantially vertical upper stem body and an elongated lower end being connected thereto in a substantially perpendicular relationship to the upper stem body, the lower end being constructed and arranged for insertion into the at least one opening and projecting into the passage whereby the lower end is in direct contact with the heatable transfer fluid; a pump in communication with the heating system for continuously circulating the heatable transfer fluid through the closed loop fluid flow circuit; and heat transfer means connected to at least a portion of the closed loop fluid flow circuit, the heat transfer means being constructed and arranged for transferring the heat from the heatable transfer fluid flowing in the closed loop fluid flow circuit to the space heated by the heating system.

According to yet another aspect of the present invention, there is provided a heating system for heating a space comprising a first flow pipe and a second flow pipe, the first flow pipe and the second flow pipe being interconnected at ends thereof to form a closed loop fluid flow circuit; a housing interconnected with the closed loop fluid flow circuit, and having a passage extending therethrough for passage of a heatable transfer fluid through the housing, the housing having at least one opening defined within the housing and separate from the passage; at least one electric heating element inserted into the at least one opening, the at least one electric heating element being removable from the housing without disassembly of the housing and without disconnection of the housing from the closed loop fluid flow circuit, and wherein the at least one electric heating element has a substantially vertical upper stem body and an elongated lower end being connected thereto in a substantially perpendicular relationship to the upper stem body, the lower end being constructed and arranged for insertion into the at least one opening and projecting into the passage whereby the lower end is in direct contact with the heatable transfer fluid; at least one electric heating element inserted into the at least one opening, the at least one electric heating element being removable from the housing without disassembly of the housing and without disconnection of the housing from the closed loop fluid flow circuit, and wherein the at least one electric heating element has a substantially vertical upper stem body and an elongated lower end being connected thereto in a substantially perpendicular relationship to the upper stem body, the lower end being constructed and arranged for insertion into the at least one opening and projecting into the passage whereby the lower end is in direct contact with the heatable transfer fluid; a pump in communication with the closed loop fluid flow circuit for continuously circulating the heatable transfer fluid through the closed loop fluid flow circuit; a power source in communication with the heating system, for supplying the at least one glow plug and the pump with power, and enabling the at least one glow plug to heat the heatable transfer fluid and the pump to circulate the heatable transfer fluid; heat transfer means connected to at least a portion of the closed loop fluid flow circuit, the heat transfer means being constructed and arranged for transferring the heat from the heatable transfer fluid flowing in the closed loop fluid flow circuit to the space heated by the heating system; and a remote device to remotely selectively activate or de-activate heating of the at least one electric heating element from a distance.

BRIEF DESCRIPTION OF THE DRAWINGS

A preferred embodiment of the present invention is described below with reference to the accompanying drawings, in which.

DESCRIPTION OF THE PREFERRED EMBODIMENT

Figure 1:
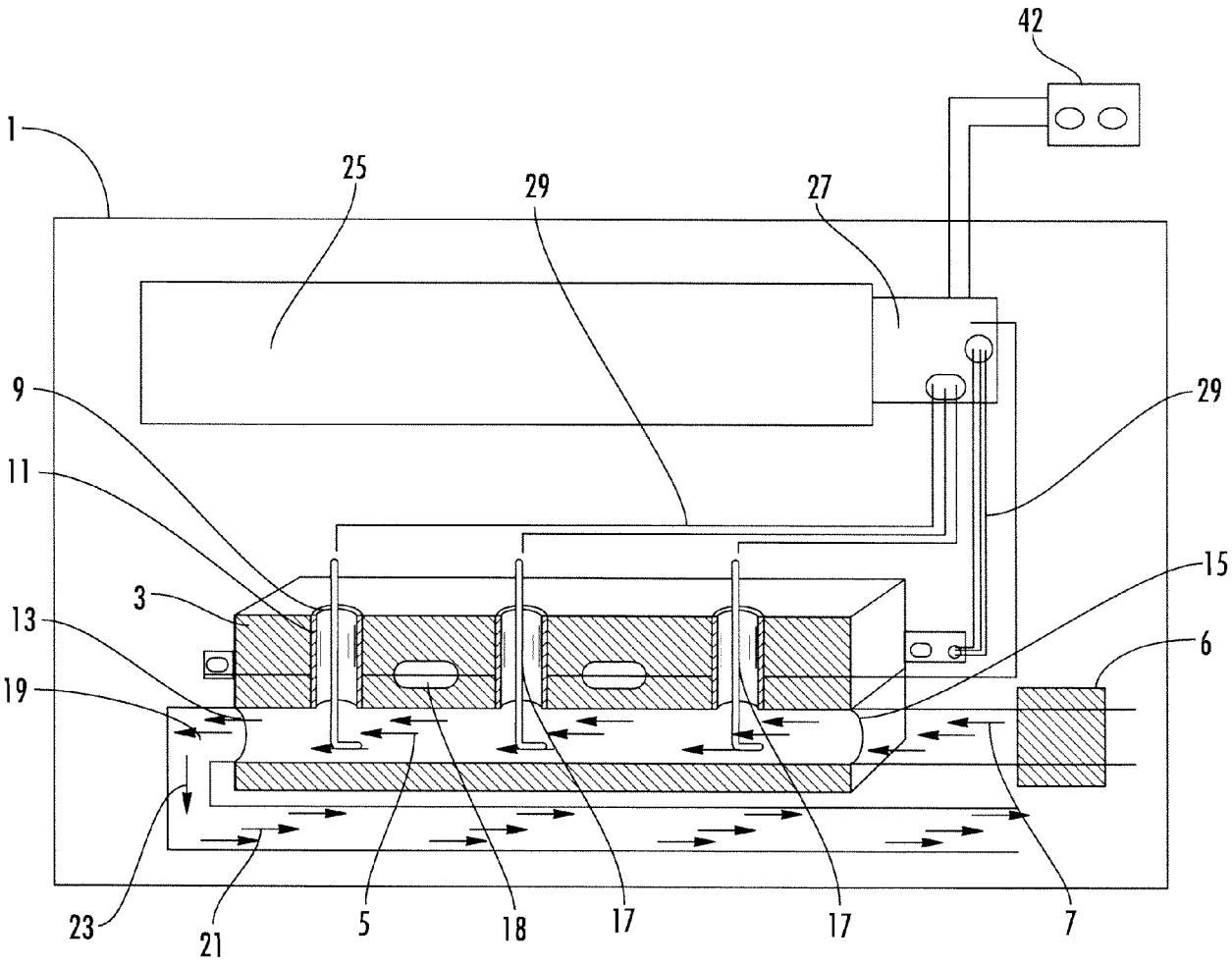
FIG. 1 is a perspective view of an embodiment of the closed loop heating system of the present invention.

In the preferred embodiment, and with reference to FIG. 1, a heating system 1 comprises a housing 3 having a passage 5 extending therethrough for passage of a heat transfer fluid 7 through the housing 3. Preferably, the heat transfer fluid 7 will be water, though it is conceivable that other fluids could be utilized, as would be apparent to one skilled in the art.

As can be seen in FIG. 1, the passage 5 of the housing 3 extends substantially horizontally throughout a length of the housing. The housing 3 further comprises at least one opening 9 on an upper surface of the housing, but more preferably, a plurality of openings defined thereon, each of which are separate from the passage 5, and each of which define an internally defined chamber 11 within the body of the housing 3. As can be seen in FIG. 1, the housing is adapted to be mounted generally horizontally. As can also be readily seen in FIG. 1, the housing 3 possesses an inlet 15 at one end of the housing, and an outlet 13 at the opposite end of the housing 3. Preferably, the housing 3 is made of metal, though it is conceivable that other materials could also be utilized, as would be apparent to one skilled in the art.

The housing 3 is interconnected with a first flow pipe 19 and a second flow pipe 21 which are interconnected at ends 23 thereof to form a closed loop fluid flow circuit, wherein the heat transfer fluid 7, or water, may flow. The closed loop fluid flow circuit will preferably be in a vacuum environment. A pump 6 is also utilized to continuously circulate the heat transfer fluid 7, or water, through the fluid flow circuit.

As can also be readily seen in FIG. 1, heating elements 17 are inserted through the opening 9 on the upper surface of the housing 3, so as to reside within the internally defined chambers 11 within the body of the housing 3. Preferably, the heating elements are DC electrical heating elements, though it is conceivable that other devices could be utilized. These can be easily removable and replaceable if required. The heating elements 17 projects into the passage 5 of the housing 3 whereby the electric heating elements 17 are in direct contact with the heat transfer fluid 7, or water flowing in the fluid flow circuit. In a preferred embodiment, each of the chambers 11 will have an associated heating element inserted therein. FIG. 1 illustrates three such removable electric heating elements 17 being utilized, though it will, of course, be understood that numerous variations to this number are possible, such as six or eight.

Figure 2:
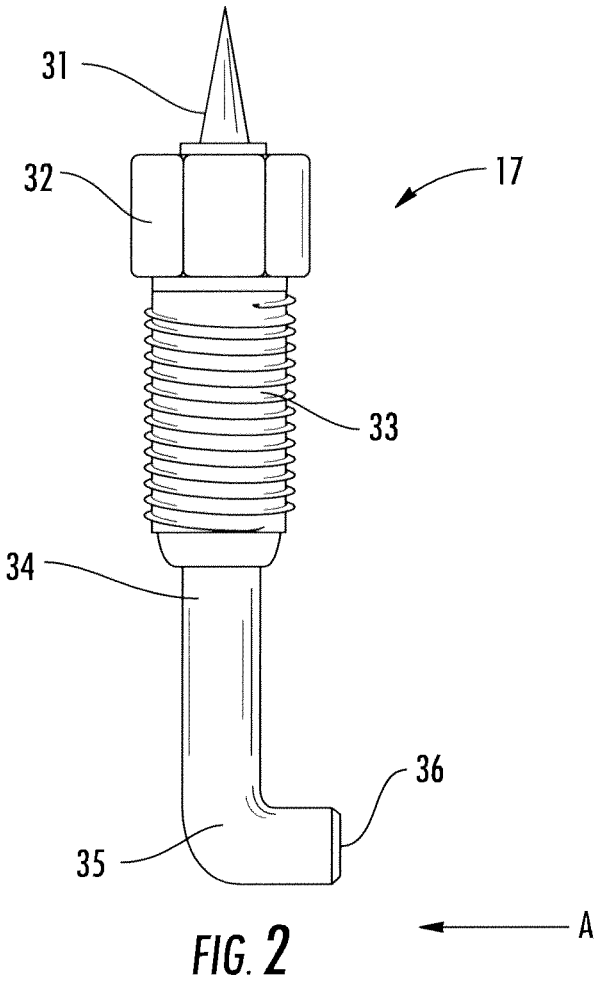
FIG. 2 is a perspective view of an embodiment of the heating element for use in the closed loop system of the present invention.

When positioned within the internally defined chambers 11 within the body of the housing 3 the heating element 17 comprises, as shown in FIG. 2, an elongated stem 34 that is inserted into chambers 11 of the housing 3. An upper end of the stem 34 comprises an electrical connection 31, which is connected to, and supplied with, electrical power from a power source 25 shown in FIG. 1, such as a battery for enabling the heating element 17 to heat the heat transfer fluid 7 being circulated by the pump 6. The electrical connection portion 31 will, preferably, be made of Inconel™, it being understood that this refers to a family of austenitic nickel chromium-based super-alloys, which are typically used in high temperature applications. Common trade names for Inconel™ include: Inconel 625™, Chronin 625™, Altemp 625™, Haynes 625™, Nickelvac 625™ and Nicrofer 6020™, for example. The stem 34, and the heating element 17, are electrically insulated by way of an insulating sheath 32 that surrounds the stem 34, so as to provide negative grounding to the device. Surrounding a substantially middle portion of the stem 34 and the insulating sheath 32 is a threaded portion 33, by which the heating element 17 can be threadably fixed and inserted into chambers 11 of the housing 3.

The heating elements 17 in the housing 3 are supplied with electrical power from a power source 25 for enabling the heating elements 17 to heat the heat transfer fluid 7, or water, within the fluid flow circuit. For example, some electrical heating elements can be heated to 3500 degrees, or temperatures in varying other degrees, and this, in combination with the temperatures generated by other elements in the housing, amounts to a considerable temperature which can be generated to heat the fluid flowing in the fluid flow circuit. In one embodiment, the power source 25 is an electrical type power source, or a DC power pack that can be plugged in by means of a power cord (not shown), though it is conceivable that, alternatively, other types of power sources could be utilized, such as solar power cells, A/C power, DC power pack, wind generated power sources or the like, as would be apparent to one skilled in the art. Of course, it would be readily apparent that such a power cell could also be re-energized or re-charged also, as is also known in the art. The power from the power source 25 is connected to the heating elements 17 by means of data board 27 and wiring 29. In a preferred embodiment, the power source 25 is a DC power pack and can be easily unplugged and replaced from the system if necessary, whereby a new power pack can be inserted.

A lower end 35 of the stem 34 will, preferably, be L-shaped, the lower end 35 thus being substantially perpendicular in relationship to the stem 34. The outermost end 36 of the lower end 35 will preferably be tapered, at least slightly. In this manner, when the heating element 17 is inserted into chambers 11 of the housing 3, so as to project downwardly into the passage 5 of the housing 3 to be direct contact with the heat transfer fluid 7, the tapered outermost end 36 of the lower end 35 will act as a breakwater to the onrushing coolant flowing past it in the passage 5, (the directional passage flow of the fluid being shown as "A" in FIG. 2) separating the heat transfer fluid 7 and forcing the heat transfer fluid 7 to flow past both sides of the lower end 35. Such a construction is advantageous when contrasted to that of a conventional electric heating element having a straight, vertically depending lower end, as when such element is vertically positioned to extend downwardly within the passage, the straight vertical lower end thereof is thus subjected to the stress of encountering fully the heat transfer fluid 7 or coolant flowing past within the passage 5. Over time, such a construction means such an electric heating element is subjected to greater structural stresses than that of the heating element 17 of the present invention, and likely will require more frequent replacement and potential for breakage.

Moreover, by virtue of the lower end 35 of the stem 23 being L-shaped, the lower end 35 possesses a greater surface area with which to contact, and thus heat the heat transfer fluid 7. This effectively means that heat transfer fluid 7 can be heated at a faster rate than a conventional electric heating element, since the heat transfer fluid 7 is separated and heated by both sides of the lower end 35, rather than just encountering, and being heated by, the immediate, and only, surface of a straight conventional electric heating element projecting downwardly in passage 5 to contact the flow of the heat transfer fluid 7. And, by virtue of the tapered outermost end 36 of the lower end 35 forcing the heat transfer fluid 7 to flow past both side of the lower end 35, the lower end 35 is thus enabled to heat the heat transfer fluid 7 in smaller quantities, since the heat transfer fluid 7 is effectively being split in half by the breakwater qualities of tapered outermost end 36.

Figure 3:
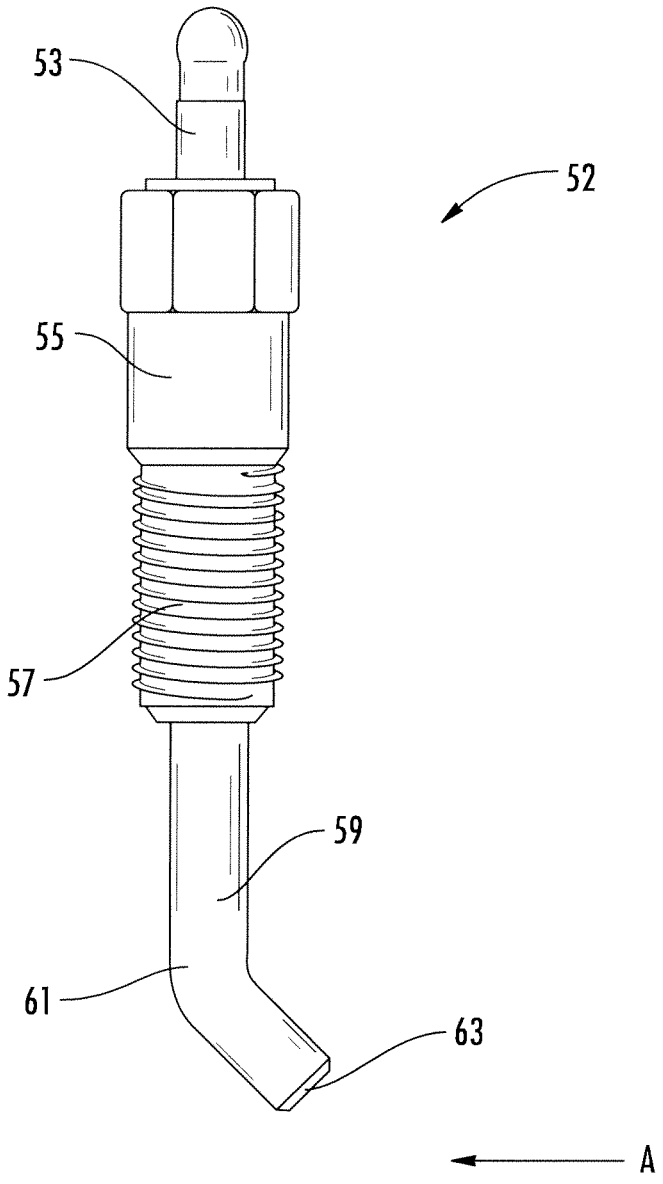
FIG. 3 is a perspective view of a further embodiment of an embodiment of a heating element that can be inserted into the housing of the closed loop system of the present invention.

As can be seen in FIG. 3, there is shown an alternative embodiment of a heating element 52 that is inserted through the opening 9 on the upper surface of the housing 3, so as to reside within the internally defined chambers 11 within the body of the housing 3, as noted previously. Preferably, any of the heating elements 52 are easily removable and replaceable if required. When positioned within the internally defined chambers 11 within the body of the housing 3 shown in FIG. 1, the heating element 52 comprises an elongated stem 59 that is inserted into chambers 11 of the housing 3. An upper end of the stem 59 comprises an electrical connection portion 53, which is connected to, and supplied with, electrical power from a power source (not shown) such as a battery for enabling the heating element 52 to heat the coolant (not shown), the coolant of course being circulated by pump (not shown). The electrical connection portion 53 will, preferably, be made of Inconel™, it being understood that this refers to a family of austenitic nickel chromium-based super-alloys, which are typically used in high temperature applications. Common trade names for Inconel™include: Inconel 625™, Chronin 625™, Altemp 625™, Haynes 625™, Nickelvac 625™ and Nicrofer 6020™, for example.

Surrounding a substantially middle portion of the stem 59 and the insulating sheath 55 is a threaded portion 57, by which the electric heating element 52 can be threadably fixed and inserted into chambers 11 of the housing 3. A lower end 61 of the stem 59 is substantially angled at a 45 degree angle and projects into the passage 5 of the housing 3 whereby the heating element 52 is in direct contact with the heat transfer fluid 7, the lower end thus being substantially perpendicular in relationship to the stem 59 and the remainder of the heating element 52, giving the lower end 61 of the heating element 52 a greater surface area with which to contact, and thus heat the heat transfer fluid 7.

The outermost point 63 of the lower end 61 will preferably be tapered, at least slightly. In this manner, when the electric heating element 52 is inserted into chambers 11 of the housing 3, so as to project downwardly into the passage 5 of the housing 3 to be in direct contact with the heat transfer fluid 7, the tapered outermost point 63 of the lower end 61 will act as a breakwater to the onrushing heat transfer fluid 7 flowing past it in the passage 5, (the directional passage flow of the heat transfer fluid 7 being shown as "A" in FIG. 3) separating the heat transfer fluid 7 and forcing the heat transfer fluid 7 to flow past both sides of the lower end 61. Such a construction is advantageous, when contrasted to that of a conventional heating element that merely extends downwardly into the passage, as when such an element is vertically positioned to extend downwardly within the passage, the vertical lower end is thus subjected to the stress of encountering fully the coolant flowing past within the passage 5. Over time, such a construction means that such a heating element is subjected to greater structural stresses than that of this embodiment of the heating element 52 of the present invention, and likely will require more frequent replacement and potential for breakage.

Moreover, by virtue of the lower end 61 of the stem 59 being substantially angled at a 45 degree angle, the lower end 61 possesses a greater surface area with which to contact, and thus heat the heat transfer fluid 7. This effectively means that heat transfer fluid 7 can be heated at a faster rate than that accomplished by a conventional heating element, since heat transfer fluid 7 is separated and heated by both sides of the lower end 61, rather than just encountering, and being heated by, the immediate, and only, surface of a conventional heating element projecting downwardly in passage 5 to contact the flow of heat transfer fluid 7. And, by virtue of the tapered outermost point 63 of the lower end 61 forcing the heat transfer fluid 7 to flow past both sides of the lower end 61, the lower end 61 is thus able to heat the heat transfer fluid 7 flowing past it in smaller quantities, since the heat transfer fluid 7 is effectively being split in half by the breakwater qualities of tapered outermost point 63, and the lower end 61 is effectively in contact with both halves of the heat transfer fluid 7 flowing past it. It will of course be understood that the lower end 61 of the stem 59 of the electric heating element 52 can be substantially angled at from between a 45 degree angle to a 90 degree angle when it is inserted into the housing 3 to project into the passage 5.

Figure 4:
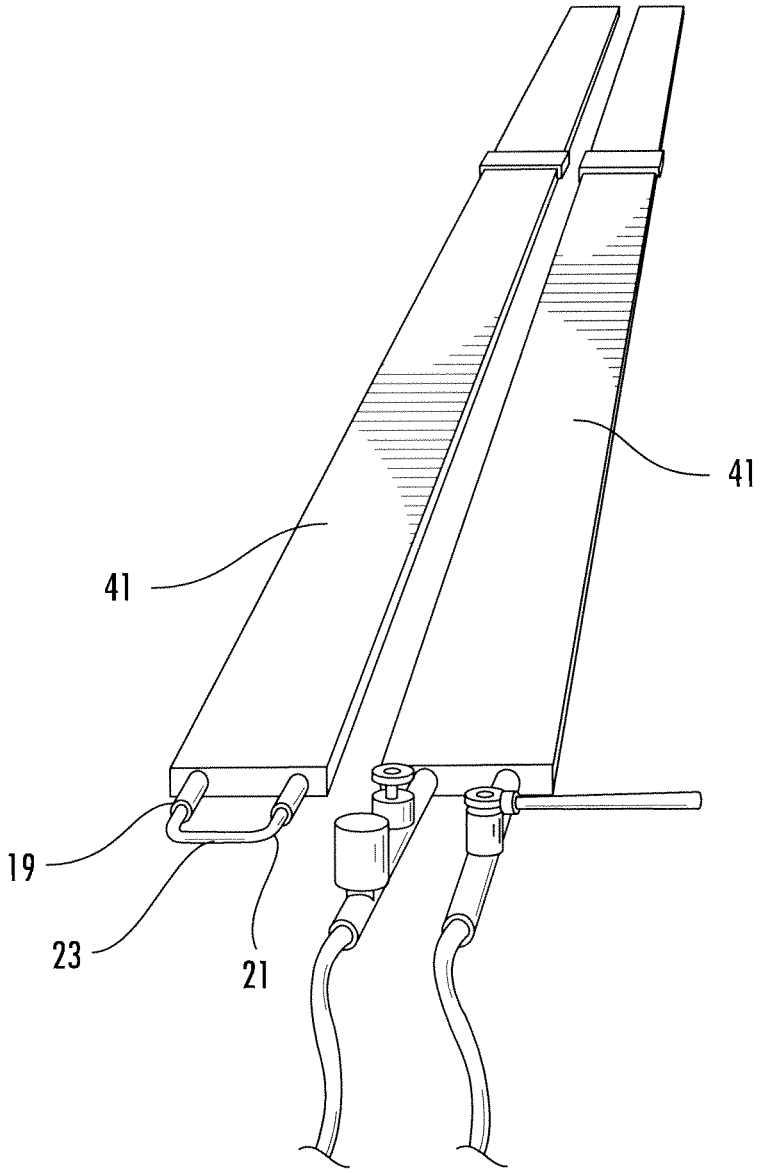
FIG. 4 is a perspective view of radiator panels connected to the first flow pipe and the second flow pipe of the fluid flow circuit.

In a preferred embodiment, and as shown in FIG. 4, radiator panels 41 are connected to the first flow pipe 19 and the second flow pipe 21 of the fluid flow circuit, to radiate the heat from the heat transfer fluid 7 flowing in the fluid flow circuit to a space (not shown) to be heated by the heating system. Such a space could be, for example, a home, a room, an office or a building. In one embodiment, the radiator panels 41 could be interconnected, with each of the radiator panels 41 having the heat transfer fluid 7, derived from the fluid flow circuit, flowing therethrough, the radiator panels 41 being in fluid flow communication therewith.

In a further embodiment, the heating system 1 includes a thermostatic safety control 18 in association with the heating elements 17, which could be installed within or on the housing 3 so as to be in association with the heating elements 17 and the other components therein, in a conventionally known manner. In a preferred embodiment, each of the heating elements 17 will have a corresponding thermostatic safety control 18 associated therewith. Each thermostatic safety control 18 is adapted to turn the heating element 17 off when a temperature of the heat transfer fluid 7 within the fluid flow circuit and the housing 3 exceeds a predetermined level, or when it is detected that a component has failed. For example, if the pump 6 malfunctions and is no longer circulating the heat transfer fluid 7 in the housing 3, each thermostatic safety control 18 activates to shut down each of the heating elements 17. Moreover, in the event of a power surge to the system, or in the event the system is too hot or too cold, each thermostatic safety control 18 activates to shut down each of the heating elements 17 to prevent damage to the system.

In an alternative embodiment, as shown in FIG. 1, the heating system of the present invention can be selectively activated (or deactivated) by a remote device 42 by a user, whereby the power source 25, activates the heating elements 17 from a distance, it being understood that the remote device used could be of a conventionally known variety. Of course, the housing 3 can also contain thereon a conventional on/off switch (not shown), as would be apparent to one skilled in the art. It is conceivable that the present invention could be utilized, but not limited to, such applications as heating a greenhouse, radiant flooring, heating an office or the like, or a home or building. In addition, it is also conceivable that a water source could also be interconnected with the closed loop fluid flow circuit of the present invention. Such a water source could be, as an example only, a water heater, which could be deactivated from operation, but which would provide sufficient quantities of water for the system. Other variations to this are possible also, as would be apparent to one skilled in the art.

Figure 5:
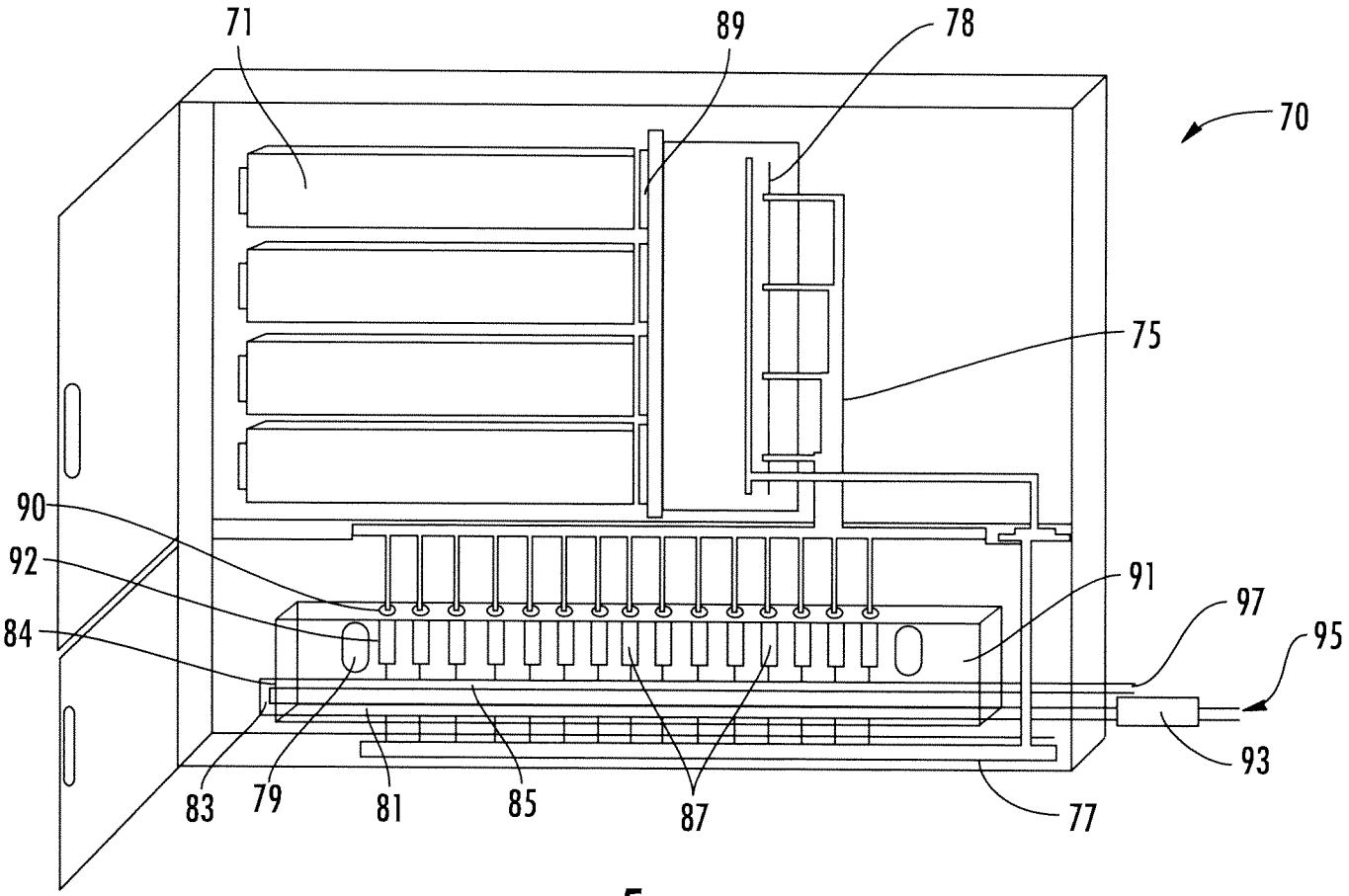
FIG. 5 is a perspective view of an embodiment of the closed loop heating system of the present invention utilized for radiant floor heating.

In a further embodiment, the heating system of the present invention, for example, could be utilized as a radiant floor heating system. With reference to FIG. 5, in this embodiment, a heating system 70 comprises a housing 91 having a passage 85 extending therethrough for passage of a heat transfer fluid (not shown) through the housing 91. Preferably, the heat transfer fluid will be water, though it is conceivable that other fluids could be utilized, as would be apparent to one skilled in the art.

The housing 91 is interconnected with a first flow pipe 81 and a second flow pipe 84 which are interconnected at ends 83 thereof to form a closed loop fluid flow circuit, wherein the heat transfer fluid may flow. The closed loop fluid flow circuit will preferably be in a vacuum environment. A pump 93, which can of a conventional sort, is also utilized to continuously circulate the heat transfer fluid through the fluid flow circuit.

As can also be readily seen in FIG. 5, heating elements 87 are inserted through the openings 90 on the upper surface of the housing 91, so as to reside within the internally defined chambers 92 within the body of the housing 91. Preferably, the heating elements are DC electrical heating elements, though it is conceivable that other devices could be utilized. These can be easily removable and replaceable if required. The heating elements 87 projects into the passage 85 of the housing 91 whereby the electric heating elements 87 are in direct contact with the heat transfer fluid flowing in the fluid flow circuit. In a preferred embodiment, each of the chambers 92 will have an associated heating element inserted therein. FIG. 5 illustrates fifteen such removable electric heating elements 87 being utilized, though it will, of course, be understood that numerous variations to this number are possible.

The heating elements 87 in the housing 91 are supplied with electrical power from a power source 71 for enabling the heating elements 87 to heat the heat transfer fluid within the fluid flow circuit. For example, some electrical heating elements can be heated to 3500 degrees, or temperatures in varying other degrees, and this, in combination with the temperatures generated by other elements in the housing, amounts to a considerable temperature which can be generated to heat the fluid flowing in the fluid flow circuit. In one embodiment, the power source 71 is an electrical type power source, or a DC power pack that can be plugged in by means of a power cord (not shown), though it is conceivable that, alternatively, other types of power sources could be utilized, such as solar power cells, A/C power, DC power pack, wind generated power sources or the like, as would be apparent to one skilled in the art. Of course, it would be readily apparent that such a power cell could also be re-energized or re-charged also, as is also known in the art. The power from the power source 71 is connected to the heating elements 87 by means of circuit board 89 and wiring 78. In a preferred embodiment, the power source 71 is a DC power pack and can be easily unplugged and replaced from the system if necessary, whereby a new power pack can be inserted.

The embodiment of the heating system 70 includes a thermostatic safety control 79 in association with the heating elements 87, which could be installed within or on the housing 91 so as to be in association with the heating elements 87 and the other components therein, in a conventionally known manner. In one embodiment, each of the heating elements 87 will have a corresponding thermostatic safety control 79 associated therewith. Each thermostatic safety control 79 is adapted to turn the heating element 87 off when a temperature of the fluid within the fluid flow circuit and the housing 91 exceeds a pre-determined level, or when it is detected that a component has failed. For example, if the pump 93 malfunctions and is no longer circulating the fluid in the housing, thermostatic safety controls 79 activates to shut down each of the heating elements 87. Moreover, in the event of a power surge to the system, or in the event the system is too hot or too cold, thermostatic safety controls 79 activates to shut down each of the heating elements 87 to prevent damage to the system.

With further reference to FIG. 5, it can be seen that the system has a ground 77 integrated with the circuit board 89 and the system. Power from power source 71 is conveyed, by means of circuit board 89, to heating line 75, which relays this power to the heating elements 87. Cold water flowing in to the system, shown at 95, from a radiator (not shown), is conveyed through first flow pipe 81 and second flow pipe 84, by means of pump 93, into the passage 85 of the housing 91 whereby the electric heating elements 87 directly contact and heat the fluid. The heat transfer fluid is then circulated out through an outlet 97 of the system, and the heat generated from the system being radiated out from conventional type components, such as radiator panels (now shown), integrated with the radiant flooring system.

The present invention has been described herein with regard to preferred embodiments. However, it will be obvious to persons skilled in the art that a number of variations and modifications can be made without departing from the scope of the invention as described herein.

The embodiments of the invention in which an exclusive property or privilege is claimed are defined as follows:

1. A closed loop heating system comprising:

a first flow pipe and a second flow pipe, the first flow pipe and the second flow pipe being interconnected at ends thereof to form a closed loop fluid flow circuit for heating a space, the closed loop fluid flow circuit being provided in a vacuum;

a housing interconnected with the closed loop fluid flow circuit, and having a passage extending therethrough for passage of a heatable transfer fluid through the housing, the housing having at least one opening defined thereon which is in communication with the passage, the at least one opening of the housing being constructed and arranged to receive at least one electric heating element for contacting the heatable transfer fluid in the passage;

the at least one electric heating element inserted into the at least one opening, wherein the at least one electric heating element has a substantially vertical upper stem body and an elongated lower end being connected thereto, the lower end is connected at a substantially angled relationship in a range of between 45 degrees to 90 degrees to a remainder of the upper stem body, the elongated lower end being constructed and arranged for insertion into the at least one opening and projecting into the passage whereby the elongated lower end is in direct contact with the heatable transfer fluid, and wherein the upper stem body is accessible from an exterior surface of the housing to permit removal of the at least one electric heating element from the housing without disassembly of the housing and without disconnection of the housing from the closed loop fluid flow circuit;

a pump in communication with the heating system, the pump continuously circulating the heatable transfer fluid through the closed loop fluid flow circuit; and at least one heat radiator connected to at least a portion of the closed loop fluid flow circuit, the at least one heat radiator being constructed and arranged for transferring heat from the heatable transfer fluid flowing in the closed loop fluid flow circuit to the space heated by the heating system.

2. The heating system of claim 1, wherein the heatable transfer fluid is water.

3. The heating system of claim 1, wherein the at least one heat radiator comprises a plurality of interconnected radiator panels in fluid flow communication with the closed loop fluid flow circuit.

4. The heating system of claim 1, wherein the at least one electric heating element is a DC heating element.

5. The heating system of claim 1, further comprising a remote device to remotely selectively activate or deactivate the at least one electrical heating element from a distance.

6. The heating system of claim 1, wherein the heating system is constructed and arranged for connection to a power source for supplying the at least one electric heating element and the pump with power, and enabling the at least one electric heating element to heat the heatable transfer fluid and the pump to circulate the heatable transfer fluid.

7. The heating system of claim 6, wherein the power source is a battery.

8. The heating system of claim 6, wherein the power source is a solar power cell.

9. The heating system of claim 6, wherein the power source is a DC power pack.

10. The heating system of claim 1, wherein the housing comprises a plurality of openings defined therein, each of the plurality of openings having an electrical heating element inserted therein.

11. The heating system of claim 1, wherein the at least one radiator comprises at least one radiator panel.

12. The heating system of claim 1, wherein the at least one radiator comprises a plurality of radiator panels.

13. The closed loop heating system of claim 1, wherein, when the at least one electric heating element receives power, the passage includes the heatable transfer fluid that is in direct contact with at least a part of the at least one electric heating element to heat the heatable transfer fluid.

14. A heating system comprising:

a first flow pipe and a second flow pipe, the first flow pipe and the second flow pipe being interconnected at ends thereof to form a closed loop fluid flow circuit for heating a space, the closed loop fluid flow circuit being provided in a vacuum;

a housing interconnected with the closed loop fluid flow circuit, and having a passage extending therethrough for passage of a heatable transfer fluid through the housing, the housing having at least one opening defined thereon and in communication with the passage, the at least one opening of the housing being constructed and arranged to receive at least one electric heating element for contacting the heatable transfer fluid in the passage, and which is removable from the housing without disassembly of the housing and without disconnection of the housing from the closed loop fluid flow circuit;

the at least one electric heating element inserted into the at least one opening, wherein the at least one electric heating element has a substantially vertical upper stem body and an elongated lower end being connected thereto, wherein the elongated lower end is connected at a substantially angled relationship in a range of between 45 degrees and 90 degrees to a remainder of the upper stem body, the elongated lower end being constructed and arranged for insertion into the at least one opening and projecting into the passage whereby the elongated lower end is in direct contact with the heatable transfer fluid;

a pump in communication with the closed loop fluid flow circuit, the pump continuously circulating the heatable transfer fluid through the closed loop fluid flow circuit;

a power source in communication with the heating system, for supplying the at least one electric heating element and the pump with power, and enabling the at least one electric heating element to heat the heatable transfer fluid and the pump to circulate the heatable transfer fluid;

at least one heat radiator connected to at least a portion of the closed loop fluid flow circuit, the at least one heat radiator being constructed and arranged for transferring heat from the heatable transfer fluid flowing in the closed loop fluid flow circuit to the space heated by the heating system; and a remote device to remotely selectively activate or deactivate heating of the at least one electric heating element from a distance.

15. The heating system of claim 14, wherein the at least one heat radiator is interconnected to, and in fluid flow communication therewith, at least a portion of the closed loop fluid flow circuit.

16. The heating system of claim 14, further comprising a reservoir interconnected with the closed loop fluid flow circuit for holding the heatable transfer fluid therein.

17. The heating system of claim 14, wherein the heatable transfer fluid is water.

18. The heating system of claim 14, wherein, when the at least one electric heating element receives power, the passage includes the heatable transfer fluid that is in direct contact with at least a part of the at least one electric heating element to heat the heatable transfer fluid.

* * * * *